US006939205B2

(12) United States Patent
Hopf et al.

(10) Patent No.: US 6,939,205 B2
(45) Date of Patent: Sep. 6, 2005

(54) DEVICE FOR PROCESSING COMPONENT PART CONTOURS

(75) Inventors: Wilhelm Hopf, Sachsenheim (DE); Frank Dahlmanns, Aachen (DE); Markus Klingel, Muehlacker (DE); Aron Mattis, Muechingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/457,341

(22) Filed: Jun. 9, 2003

(65) Prior Publication Data

US 2004/0063386 A1 Apr. 1, 2004

(30) Foreign Application Priority Data

Jun. 7, 2002 (DE) ..... 102 25 304

(51) Int. Cl.[7] ..... B24B 1/00; B24C 1/00
(52) U.S. Cl. ..... 451/38; 451/102
(58) Field of Search ..... 451/90, 99, 102, 451/38

(56) References Cited

U.S. PATENT DOCUMENTS 1,940,539 A * 12/1933 Fritsche ..... 451/89
2,371,434 A * 3/1945 Eppler ..... 451/99
2,577,465 A * 12/1951 Jones et al. ..... 451/90
3,276,168 A * 10/1966 Stewart ..... 451/90
3,476,323 A * 11/1969 Downie ..... 239/590.5
3,624,966 A * 12/1971 Palmer ..... 451/90
3,626,841 A * 12/1971 Schachter ..... 451/90
4,232,487 A * 11/1980 Brown ..... 451/88
5,125,979 A * 6/1992 Swain et al. ..... 134/7
5,514,026 A * 5/1996 Schaffer ..... 451/90
5,626,508 A * 5/1997 Rankin et al. ..... 451/102
5,876,267 A * 3/1999 Kanda ..... 451/38
6,149,509 A * 11/2000 Bruns et al. ..... 451/90
6,273,789 B1 * 8/2001 LaSalle et al. ..... 451/38
6,626,738 B1 * 9/2003 Shank ..... 451/39

* cited by examiner

*Primary Examiner*—M. Rachuba
(74) *Attorney, Agent, or Firm*—Kenyon & Kenyon

(57) ABSTRACT

A device for processing, particularly deburring, rounding and/or hardening component part contours, is provided, including a compressed air channel for supplying compressed air, an abrasive channel for supplying abrasive material and an ejector nozzle for ejecting the abrasive material. The ejector nozzle is positioned with its axis essentially transverse to the longitudinal extension of the compressed air channel and of the abrasive channel and the acceleration of the abrasive material takes place essentially in the ejector nozzle.

14 Claims, 5 Drawing Sheets

DEVICE FOR PROCESSING COMPONENT PART CONTOURS

FIELD OF THE INVENTION

The present invention relates to a device for processing component contours, especially for deburing, rounding and/or hardening component contours.

BACKGROUND INFORMATION

A device for processing surfaces may be designed, for example, as a glass ball or steel ball blasting device. Compressed air may be brought forward via a compressed air channel and abrasive material may be conveyed into a nozzle region and from there may be expelled together with the compressed air via an ejector nozzle in the direction of the surface to be processed.

Stress of components and component parts that have pressure applied to them by a pulsing load at high pressures may be characteristic in the field of injection technology. In this connection, in the case of high injection pressures the problem may arise that the component parts made in the usual way are not able to be designed so that they have resistance to fatigue. Burrs, sharp edges and notches, which may be present, especially at inner-lying faulty bore cuttings, represent a reduction in fatigue strength in the inner region of the respective component part subjected to pressure. It may be necessary to design the inner region of the component part subjected to pressure so that it has a clean, burr-free or definedly rounded contour, even in the case of inner-lying, faultily cut bores that are difficult to access.

Inner-lying surfaces of component parts may be processed by being acted upon by pressure, for example, according to a thermal deburring method, a hydro-erosive rounding method, an electrochemical processing method or a flow-through lapping method.

However, all these methods have disadvantages: all the aforementioned processing methods are time-consuming.

In the thermal deburring method (TDM), for example, undesired residual tensile stresses may appear as a result of the thermal influences.

In the hydro-erosive rounding method, the cleaning expenditure after processing may be very high, since oil is used during processing, which has to be removed. Furthermore, process safety may be low, since there may be problems with massive burr roots.

In the case of electronic processing, the cleaning expenditure may also be relatively high because of the oil used. There may also be process interference if there is contact between a structural element and an electrode.

In flow-through lapping, also called AFM (abrasive flow machining), there may also be a high cleaning expenditure. Moreover, high expenditures may be created by wear of high-value components and by the expendable supplies used. In addition, component parts which are processed after such methods may have to be submitted to reworking.

Furthermore, for processing surfaces lying inside a component part, interior dry jet cuttings systems have been used. In interior dry jet cuttings systems, an abrasive material is accelerated coaxially with the extent of a jet lance and is deflected as needed, shortly before exiting from a nozzle, at a deflecting plate that is resistant to wear. However, this system does not yield satisfactory results, since, because of the deflecting process, no clean, statistical distribution may be ensured of the jet density of the jet-propelled abrasive material in the direction of the surface to be processed.

SUMMARY OF THE INVENTION

The device according to an exemplary embodiment of the present invention for processing, especially for deburring, rounding and/or hardening component-part contours includes an ejector nozzle positioned with its axis essentially transverse to the longitudinal extension of the compressed air channel and the abrasive channel. The acceleration of the abrasive material takes place essentially in the ejector nozzle. The device has the advantage that it makes possible, a small, compact type of construction, which may be conveniently introduced into inner spaces which are difficult to access. The device also has the advantage that the ejector nozzle is to a large extent free from wear, since the abrasive material is accelerated in the ejector nozzle only shortly before exiting from the device, and is not deflected.

The alignment of the ejector nozzle according to an exemplary embodiment of the present invention additionally ensures an essentially conical exit jet, so that the jet density may have a defined statistical distribution over the width of the jet.

It may be advantageous if the ejector nozzle is designed on the Venturi principle, there being a combination of the ejector principle and the Venturi principle. The abrasive material may be aspirated using the compressed air and may be ejected together with the compressed air, and the compressed air may be accelerated together with the abrasive material in a simple manner according to the Venturi principle, i.e. via a cross sectional narrowing Short processing times of the respective surface may be implemented using the device according to an exemplary embodiment of the present invention. The component part may be given an increased resistance to vibration in the region processed by the generation of residual compressive stresses. The residual compressive stresses may be generated by the effect of impulses of the abrasive material upon impact, at which point a compression of the structure of the component part's processed region may be effected.

The costs of operating the device according to an exemplary embodiment of the present invention is low, because the only items that are used are compressed air and the abrasive material, which involve relatively low costs.

Steel grit may be used, for example, as the abrasive material, or steel shot, which may lead to a low cleaning expenditure after processing.

Using an abrasive material such as steel grit also may ensure high material removal in the area of the respective component part processed, which may lead to a safer deburring or rounding in the processed area of the component part.

The acceleration of the compressed air together with the abrasive material may be achieved by having the ejector nozzle formed from a sleeve, which may be aligned essentially at right angles to the axis of a housing in whose longitudinal direction the compressed air channel and the abrasive channel run.

The sleeve, which may be press-fit into a threaded tube, may be expediently situated in a transverse bore in the housing, and may define a cross sectional narrowing of the transverse bore. The acceleration of the abrasive material may then take place essentially during passing through the sleeve, which may have a length of less than 3 mm.

The abrasive channel may expediently open out into the transverse bore upstream from the sleeve and downstream from the compressed air channel.

A simple production of the compressed air channel in the device according to an exemplary embodiment of the present invention may be ensured if the compressed air channel is formed from place to place by a groove at the circumference of the housing.

In order to encapsulate the device according to an exemplary embodiment of the present invention, or in order to radially limit the groove that forms the compressed air channel, the housing may be enclosed in a casing.

A balanced entry of the abrasive material into the transverse bore may be achieved if the opening-out cross section of the abrasive channel is designed to be substantially oval.

A compressed air nozzle may be positioned between the compressed air channel and the transverse bore for the introduction of the compressed air into the transverse bore In an exemplary embodiment of the device according to the present invention, in which a balanced transition between a region of the abrasive channel having a round cross section and an opening out cross section having a substantially oval cross section may be ensured, the abrasive channel is made up at least from place to place of a reshaped bore. The reshaped region of the bore may be produced in that, on the blank that forms the housing, which is provided with a longitudinal bore, using a screw press, pressure may be exerted from place to place, and thus a partial reshaping of the blank, and thus of the bore, may take place.

The device according to an exemplary embodiment of the present invention may be particularly suitable for processing of internal faulty bore cutting in bores having a small cross section. For instance, the device according to an exemplary embodiment of the present invention may be designed so that it may be introduced into a bore of a diameter of less than 10 mm, for instance 6 mm. An application example for internal faulty bore cuttings that are difficult to access is given by a rail or a pressure reservoir of a common rail injection system.

Accordingly, an exemplary method of the present invention includes using the device for deburring, rounding and hardening internally-lying faulty bore cuttings of a component part, particularly of a fuel injector system.

An exemplary method for producing a device for processing, such as deburring, rounding and/or hardening of component part contours, especially for producing a device as above, is provided.

DETAILED DESCRIPTION

Figure 1:
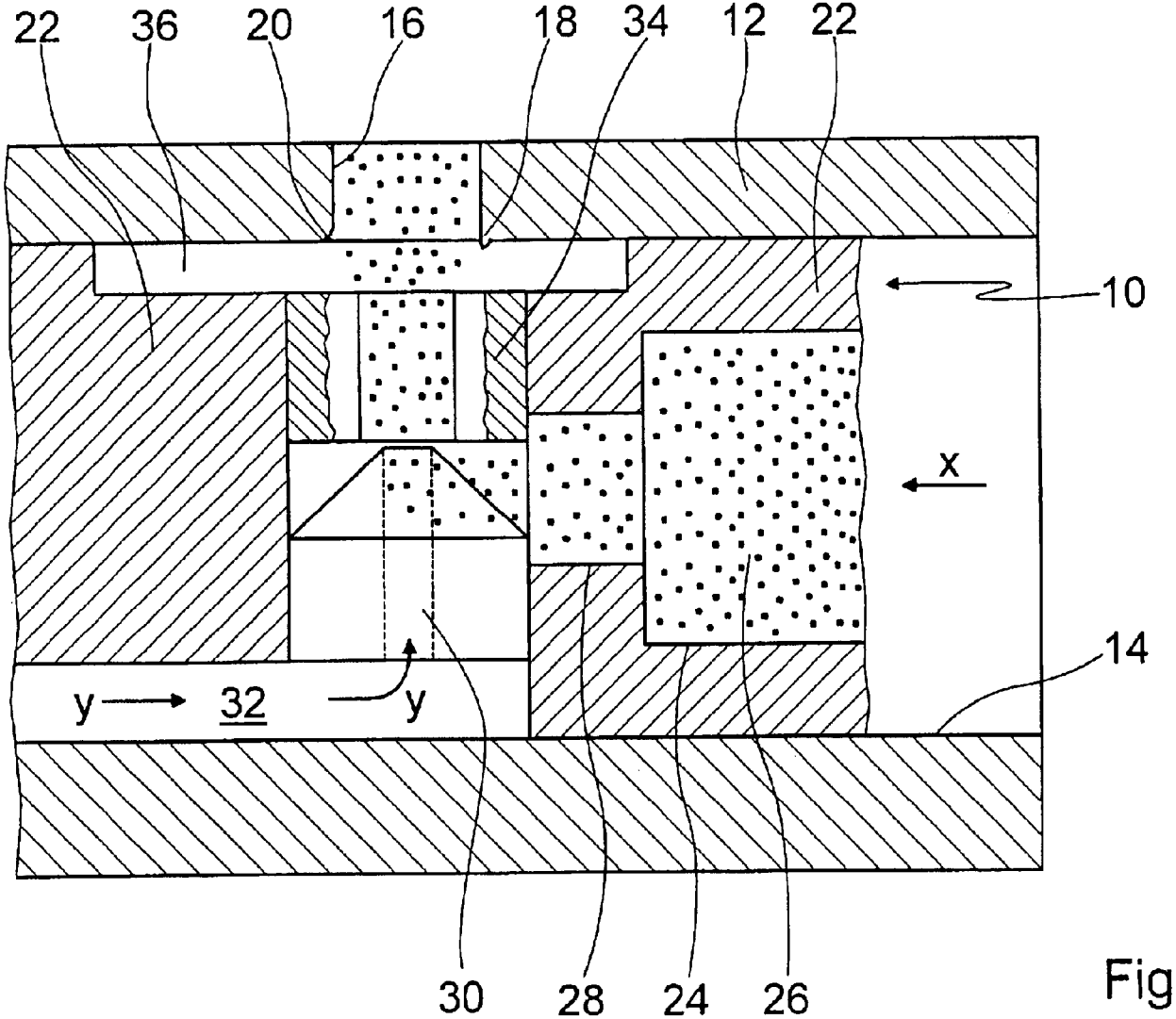
FIG. 1 illustrates a first exemplary embodiment of the device according to the present invention during deburring of a faulty bore cutting.

FIG. 1 shows a first exemplary embodiment of a device according to the present invention, designed as a steel grit blast device 10, in use in a pressure reservoir 12 of a common rail injection system of an internal combustion machine.

Device 10 is used in the present case for deburring and rounding a faulty cutting region between a main bore 14 and a transverse bore 16. Device 10 is guided in main bore 14. In the present case, the region of faulty cutting is denoted by reference numerals 18 and 20, respectively, which, before being processed, has a burr, as shown in region 18, and, after processing with the aid of device 10, is formed rounded and deburred, as shown in region 20.

Device 10 includes a housing member 22, whose axis is aligned parallel to the extension of pressure reservoir 12. In housing 22 there is a channel 24 for supplying abrasive material 26, which may be made up of steel grit having a grain size of about 250 $\mu$m. Abrasive material 26 is conveyed from a supply tank in the direction of an arrow X into abrasive channel 24.

Abrasive channel 24 opens out via a narrowed discharge region 28 into a transverse bore 30 of housing member 22. This transverse bore 30 may have a diameter of 5 mm.

The inside diameter of pressure reservoir 12 and the outside diameter of housing member 22 may be approximately 10 mm. The diameter of abrasive channel 24 may be approximately 6 mm, and the diameter of narrowed region 28 of abrasive channel 24 may be approximately 3 mm.

From the side of housing member 22 facing away from abrasive channel 24, a compressed air channel 32 opens out into transverse bore 30, compressed air channel 32 being formed as a groove at the circumference of housing member 22, and is aligned essentially parallel to the extension direction of housing member 22. During the operation of device 10, compressed air is conveyed into transverse bore 30 on a path shown by arrows Y, via compressed air channel 32. The compressed air may be under a pressure of about 5 bar in the compressed air channel 32.

At the end facing away from compressed air channel 32, a sleeve 34 has been pressed into transverse bore 30, which may have a length of about 2.9 mm and an inside diameter of about 2 mm. In the position shown in FIG. 1, the axis of sleeve 34 may be aligned with the axis of transverse bore 16 of pressure reservoir 12. Sleeve 34 may preferably be made of wear-resistant ultrafine-grain carbide steel made according to a spark erosion method.

In the vicinity of sleeve 34 there is a gap 36 between device 10 and the inner wall of pressure reservoir 12, which is formed by a recess in valve body 22.

Device 10 may work in a manner described below.

Abrasive material 26 is made available via compressed air channel 24 and its opening out region 28. This is sucked into transverse bore 30 with the aid of compressed air conveyed in the direction of arrows Y and via compressed air channel 32 into transverse bore 30, and from there it is accelerated via the bore of sleeve 34, which forms an ejector nozzle and is ejected using an essentially conical exit jet from device 10 onto the faulty cutting of bores 14 and 16.

The acceleration of abrasive material 26 may take place predominantly on the short path of the passage through sleeve 34.

Device 10, which represents a nozzle tip, is able to be moved, during the processing of faulty cutting region 18 or 20, radially, axially continuously or in a vibrating manner relative to pressure reservoir 12, whereby the jet of abrasive material 26 is able to be purposefully influenced in a manner depending on the application in question.

The impulse effect of the abrasive material ejected with the aid of device 10 brings about strain hardening, i.e., a compression of the edge zone of the work piece in region 18 or 20, and the creation of residual compressive stresses is favored, which has a positive effect on the fatigue strength of pressure reservoir 12. At the same time, regions 18 and 20 are rounded.

The small, compact type of construction and the freedom from wear of the nozzle formed by sleeve 34 is made possible because abrasive material 26 is accelerated only shortly before exiting from the nozzle and is not deflected any more. A sufficiently strong underpressure is created in transverse bore 30 to suck in abrasive material 26. This takes place by the combined application of the Venturi principle and the ejector principle. Abrasive material 26 is, on the one hand, sucked in, and, on the other hand, is sufficiently accelerated on the short path in sleeve 34 to achieve the intended effect.

Figure 2:
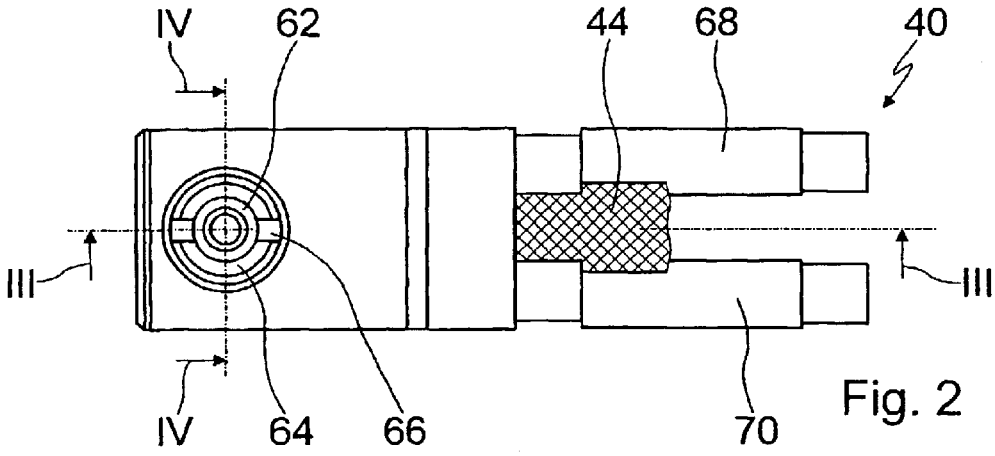
FIG. 2 shows a top view of a second exemplary embodiment of the present invention.
Figure 3:
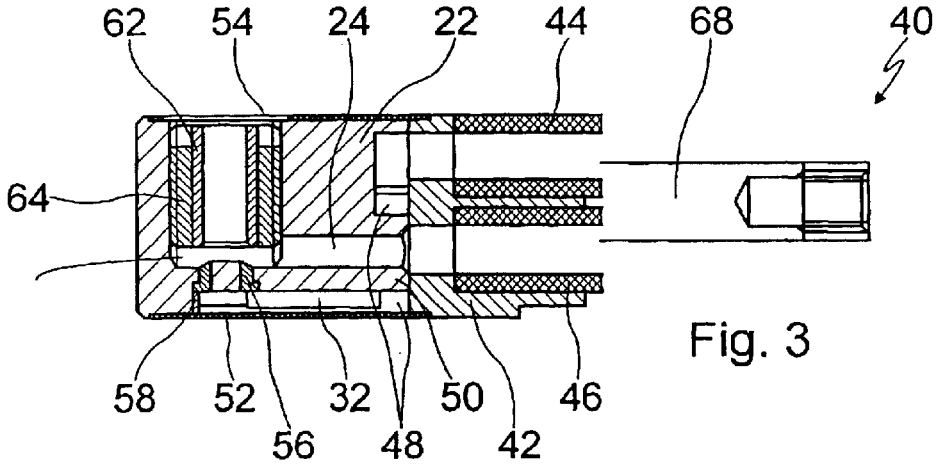
FIG. 3 shows a section through the exemplary embodiment of the present invention shown in FIG. 2, taken along the line III—III in FIG. 2.
Figure 4:
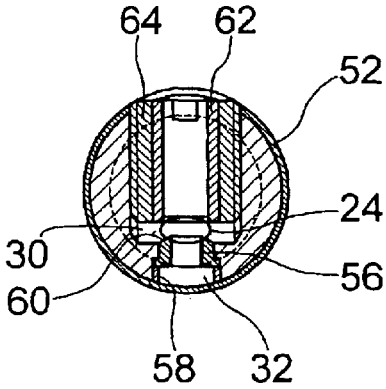
FIG. 4 shows a cross section through the exemplary embodiment of the present invention of FIG. 2 and FIG. 3, taken along the line IV—IV in FIG. 2.

In FIGS. 2 through 4, in each case a second exemplary embodiment of a device 40 according to the present invention is shown as an abstracted diagrammatic sketch which works according to the same principle as the device in FIG. 1.

Device 40 differs from the device as in FIG. 1 in that abrasive channel 24 and compressed air channel 32, which are developed in housing member 22, open out into a transverse bore 30 of housing member 22 while coming from the same direction.

In addition, a hose coupling fitting 42 connects to housing member 22, which is used to connect a compressed air hose 44 and an abrasive hose 46. Compressed air hose 44 opens out into an approximately annular cavity 48, which leads to compressed air channel 32 and surrounds a plug-like region 50 of housing member 22, in which a region of abrasive channel 24 is formed. The axis of abrasive hose 46 is aligned with abrasive channel 24.

Device 40 also has a casing 52 which radially limits compressed air channel 32 and has a cutout 54, into which transverse bore 30 of housing member 22 opens out.

Compressed air channel 32 opens out via a compressed air nozzle 56 into transverse bore 30, which is fastened to housing member 22 by a clamping ring 58, and has a chamfering 60 at the downstream end face. Nozzle 56 is situated upstream from the opening out of abrasive channel 24, which has an oval opening cross section clearly visible in FIG. 4, at the upstream end face of transverse bore 30.

Furthermore, in transverse bore 30 a sleeve 62, which forms a nozzle, is situated, whose axis is positioned at right angles to the axis of housing member 22, and which is pressed into a threaded tube 64, which is screwed into a corresponding thread of transverse bore 30. For fastening and detaching, threaded tube 64 may have slots 66 at its outside end face, in which to engage a screwing tool.

Moreover, device 40 may include two threaded tubes 68 and 70, which are used for fastening to a carrier.

FIGS. 5*a* through 5*l* show the production of a third exemplary embodiment of a device according to the present invention. This device is used for processing a tube having an inside diameter of approximately 6 mm.

Figure 5A:
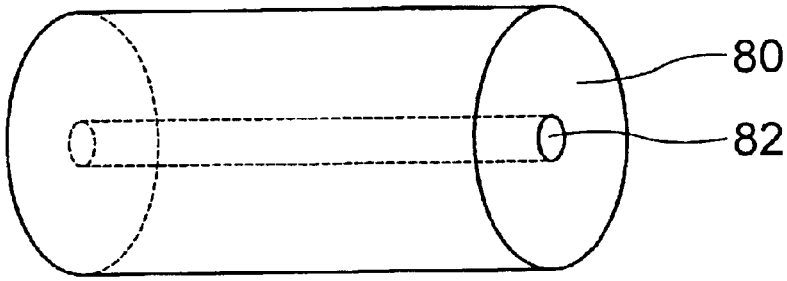
FIGS. 5*a* through 5*l* illustrate a third exemplary embodiment of a device according to the present invention at different stages of the production process.

In order to produce the nozzle tip which embodies the device, blank 80 shown in FIG. 5*a* is used, which has an outside diameter of 17 mm and an eccentric longitudinal bore 82 having a diameter of approximately 2.5 mm, which is used as the abrasive channel in the finished product. Blank 80 is made of case-hardening steel, for example, a steel of the type 20MnCrS5.

Figure 5B:
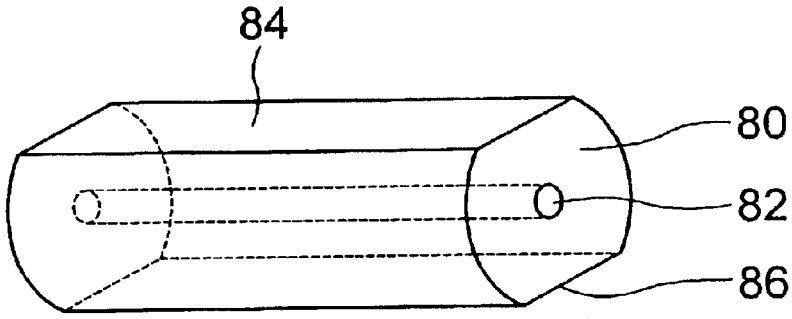
Figure 5C:
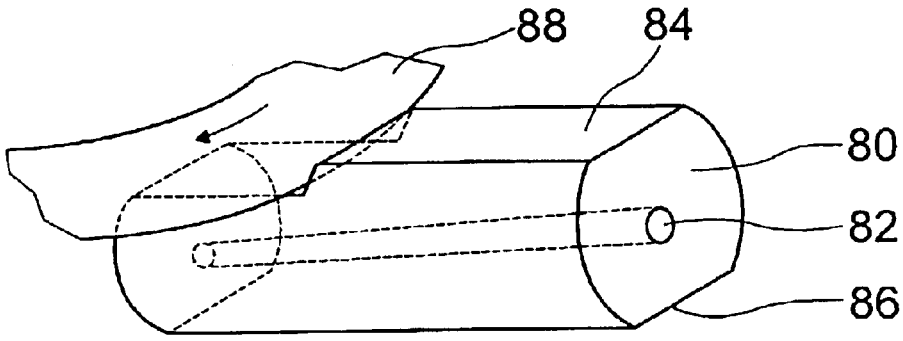

In a first working step, whose result is shown in FIG. 5*b*, blank 80 is furnished with two plane-parallel surfaces 84 and 86, surface 86 forming a contact surface and surface 84 forming a working surface for a screw press 88, which is shown in FIG. 5*c*.

Screw press 88 is applied at one area of working surface 84, so that a radial pressure is exerted on blank 80, and blank 80 is deformed. In the area in which the screw press 88 is applied, on account of the deformation, bore 82 experiences a lowering by the extension d1. In addition, bore 82 experiences a deformation in the lowered region, so that it has an oval cross section.

Figure 5D:
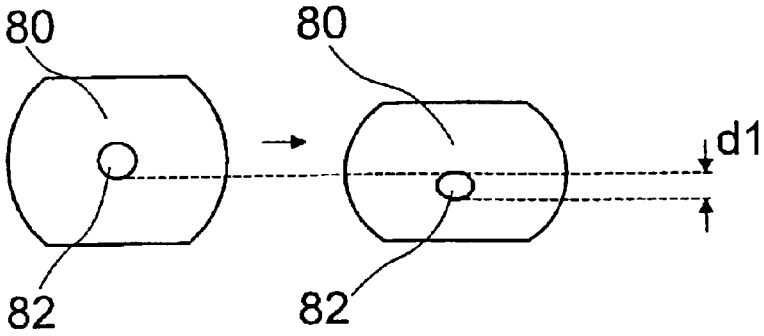

In FIG. 5*d* this process is shown by a top view of the end face of the undeformed region and a top view of the end face of the deformed region of blank 80.

In a next method step, the position of bore 82 in the nozzle tip to be produced is established. This is necessary since the position of the bore regions deformed with the aid of screw press 88 is not exactly predictable.

Figure 5E:
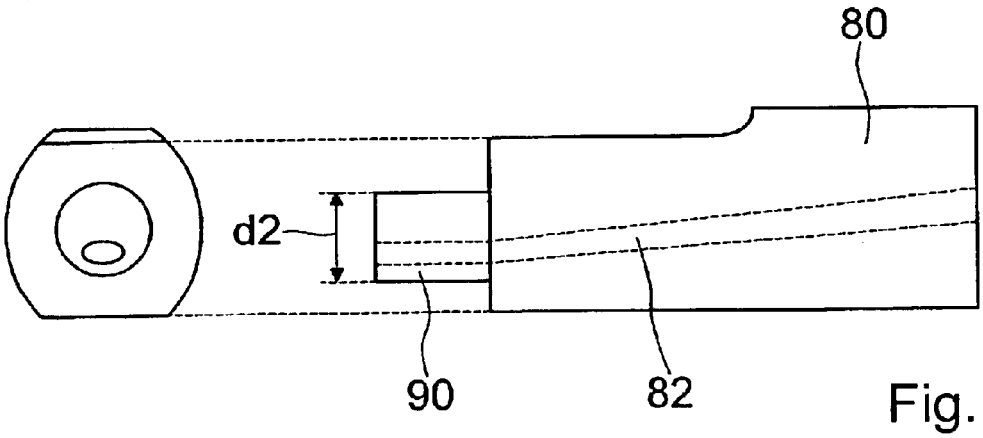

In accordance with the established position of the deformed region of bore 82, blank 80 is brought to a desired outer diameter d2 of 6 mm in the present case. For this purpose, first of all a round neck 90 having a diameter d2 is milled on blank 80, as shown in FIG. 5*e*.

Figure 5F:
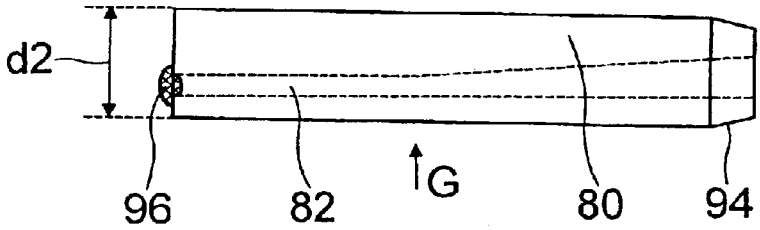

In a next step, shown in FIG. 5*f*, blank 80 is turned down to diameter d2, of 6 mm, over its entire length. At the undeformed end, blank 80 is furnished with a chamfer 94 of 15°. In addition, the end of bore 82 facing away from chamfer 94 is closed off, for instance, with the aid of a welding cap 96.

Figure 5G:
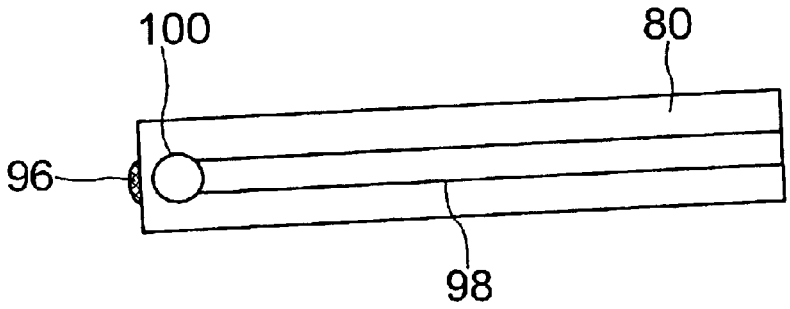

In a next working step, whose result is shown in FIG. 5*g*, the view of which corresponds to a viewing direction marked with an arrow G in FIG. 5*f*, the deformed and turned down blank 80 is provided with a longitudinal groove 98, which forms a compressed air channel in the finished product. Furthermore, processed blank 80 is furnished with a transverse bore 100 in the end region associated with welding cap 96, which in the present case has a diameter of approximately 3 mm, and into which groove 98 opens out with its end facing welding cap 96.

Figure 5H:
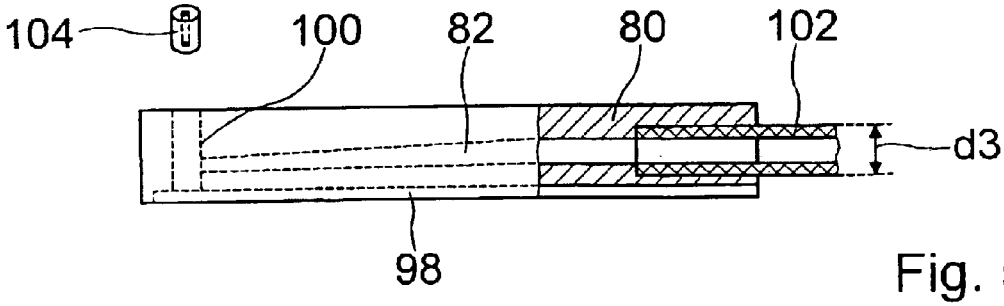

In a further production step shown in FIG. 5*h*, bore 82 is drilled open to a diameter d3 of 4 mm, in the end region facing away from transverse bore 100, for connecting an hose conveying abrasive. Also, cap 96 is removed.

In addition, a stud 104 having a diameter of 3 mm is produced, which may be made of the same material as blank 80, and which is used to be applied in transverse bore 100. Blank 80 and stud 104 may be carburized and hardened.

Figure 5I:
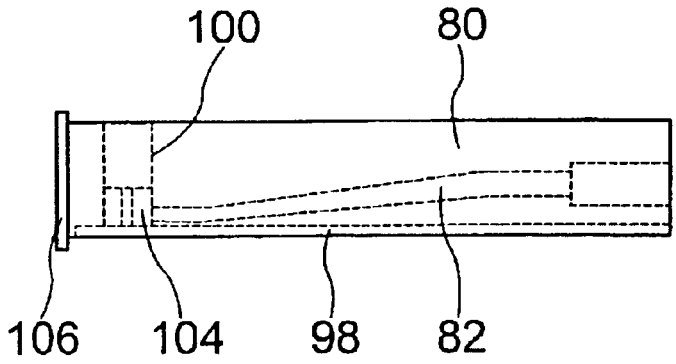

Blank 80, thus processed, is ground over its entire length to a diameter of approximately 5.8 mm, with the aid of a step shown in FIG. 5*i*. Moreover, stud 104 is fastened in transverse bore 100, for instance, by an adhesive, so that one end face of stud 104 is aligned with the radially interior limitation of groove 98. Furthermore, processed blank 80 is furnished with an end cover plate 106.

Figure 5J:
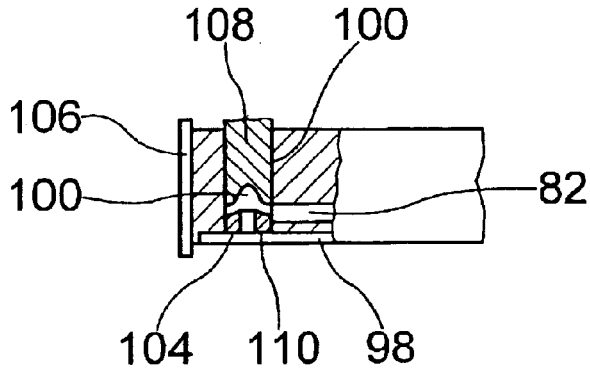

In an additional method step shown in FIG. 5*j*, stud 104 is processed using a spark erosion tool 108 that is inserted into transverse bore 100, in such a way that groove 98 opens out freely into transverse bore 100 through stud 104, which is a tubular stud, and stud 104 has a chamfering 110 at its end face facing away from groove 98.

Figure 5K:
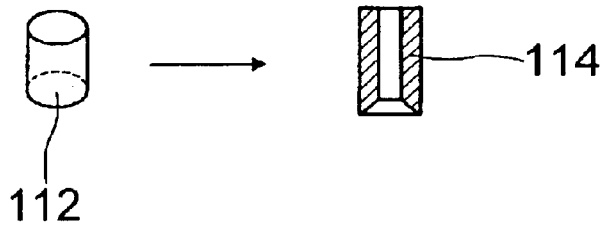

Furthermore, as shown in FIG. 5*k*, a sleeve 114 is produced, preferably after a spark erosion method, from a blank stud 112 having a diameter of approximately 3 mm, and it is made of a hard metal, for instance a hard metal of the micrograin type known by the trade name Bidurit-MG12, and has an inside diameter of approximately 2 mm.

Figure 5L:
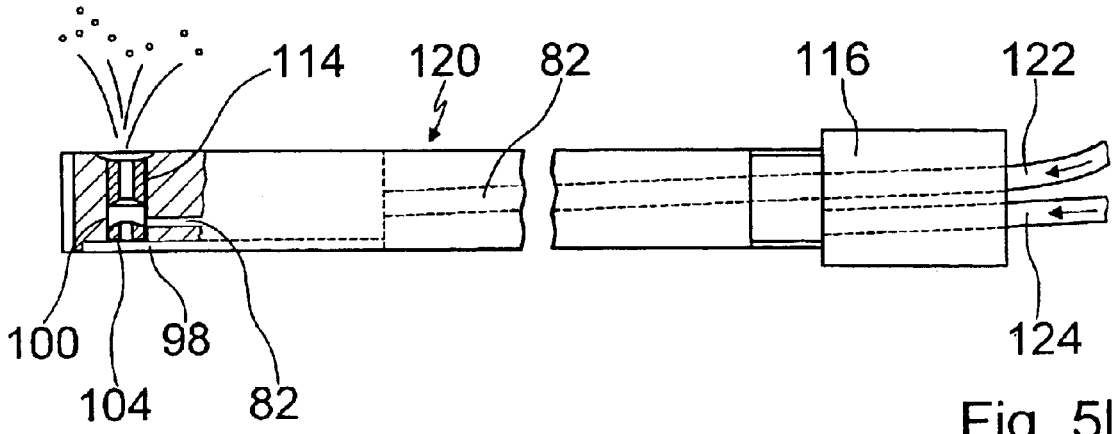

In a further working step, whose result is shown in FIG. 5*l*, sleeve 114 is pressed into transverse bore 100, and thus forms an ejector nozzle.

Finally, processed blank 80, which now has an outside diameter of approximately 5.8 mm, is sheathed in a tube having dimensions of approximately 6×0.1 mm. To do this, the nozzle member may be expediently deep-cooled, and the tube may be heated and lubricated with graphite.

FIG. 5*l* shows the finished product, which has a length of about approximately 400 mm, in use. For this, a plastic sleeve 116 is put onto nozzle member 120 at the end facing away from bore 114, so that bore 82 is connected to abrasive hose 122 and groove 98 is connected to compressed air hose 124, and abrasive material 86 is ejected from nozzle 114 together with the compressed air.

The device shown in FIG. 5*l* may work according to the principle described in connection with the exemplary embodiment according to FIG. 1.

It should be understood that the steps of the production method that were pointed out may be carried out in a different sequence, depending upon the application. Individual steps may possibly be omitted, and/or further processing steps may be added.

What is claimed is:

1. A method for processing a component part contour, comprising:

providing a device for processing a component part contour, the device including a compressed air channel adapted to supply compressed air, an abrasive channel adapted to supply abrasive material, a cross section of an opening out of the abrasive channel being substantially oval, and an ejector nozzle adapted to eject the abrasive material;

positioning a longitudinal axis of the ejector nozzle essentially transverse to a longitudinal axis of the compressed air channel and a longitudinal axis of the abrasive channel; and accelerating the abrasive material in the ejector nozzle.

2. A device for processing at least one component part contour, comprising:

a compressed air channel adapted to supply compressed air;

an abrasive channel adapted to supply abrasive material; and an ejector nozzle adapted to eject the abrasive material wherein an elongated axis of the ejector nozzle is essentially transverse to a longitudinal axis of the compressed air channel and a longitudinal axis of the abrasive channel, wherein an acceleration of the abrasive material substantially occurs in the ejector nozzle, and wherein a cross section of an opening out of the abrasive channel is substantially oval.

3. The device of claim 2, wherein the acceleration of the abrasive material in the ejector nozzle occurs according to the Venturi principle.

4. The device of claim 2, further comprising a housing, wherein:

the ejector nozzle is formed by a sleeve which is substantially aligned at a right angle to longitudinal axis of the housing; and the compressed air channel and the abrasive channel extend substantially aligned with the longitudinal axis of the housing.

5. The device of claim 4, wherein the sleeve is pressed into a threaded tube.

6. The device of claim 4, wherein the abrasive channel opens out into a transverse bore at an upstream end of the sleeve and downstream from the compressed air channel.

7. The device of claim 4, wherein the compressed air channel is formed at least intermittently by a groove at a circumference of the housing.

8. The device of claim 4, wherein the housing is enclosed by a casing.

9. The device of claim 2, wherein the compressed air channel opens out into a compressed air nozzle, the compressed air nozzle being upstream from an opening out of the abrasive channel.

10. The device of claim 2, wherein the abrasive channel is formed at least intermittently from a reformed bore.

11. The device of claim 2, wherein the abrasive material includes one of steel grit and steel shot.

12. The device of claim 2, wherein a compressed air in the compressed air channel is under a pressure of about 5 bar.

13. The device of claim 2, wherein the device has a round cross section and a diameter of less than approximately 10 mm.

14. The device of claim 2, where the device is for at least one of deburring, rounding and hardening, of at least one component part contour.

* * * * *